US005692734A

United States Patent [19]

Aldredge, Sr.

[11] Patent Number: 5,692,734

[45] Date of Patent: Dec. 2, 1997

[54] CLAMP STRUCTURE

[75] Inventor: Robert Aldredge, Sr., Dayton, Ohio

[73] Assignee: American Tool Companies, Inc., Kenosha, Wis.

[21] Appl. No.: 344,852

[22] Filed: Nov. 25, 1994

Related U.S. Application Data

[63] Continuation of Ser. No. 92,363, Jul. 15, 1993, abandoned.

[51] Int. Cl.[6] ..... B25B 1/08

[52] U.S. Cl. ..... 269/166; 269/224; 269/236

[58] Field of Search ..... 269/236, 232, 269/166, 254 R, 224, 171, 171.5, 147–149

[56] References Cited

U.S. PATENT DOCUMENTS

| | | | |
|---|---|---|---|
| 100,642 | 3/1870 | Lambert . | |
| 153,206 | 7/1874 | Van Wagoner . | |
| D. 222,872 | 1/1972 | Boucher . | |
| 226,617 | 4/1880 | Konig | 269/171.5 |
| D. 227,192 | 6/1973 | Schafhauser . | |
| D. 238,140 | 12/1975 | Guimarin . | |
| D. 259,327 | 5/1981 | Sloane . | |
| 267,152 | 11/1882 | Cloud . | |
| D. 286,369 | 10/1986 | Hahn . | |
| D. 333,963 | 3/1993 | Goodman . | |
| D. 340,632 | 10/1993 | Easley . | |
| D. 346,942 | 5/1994 | Sawdon . | |
| D. 355,104 | 2/1995 | Sorenson et al. . | |
| D. 365,263 | 12/1995 | Sorensen et al. . | |
| 404,368 | 5/1889 | Stearns . | |
| 408,473 | 8/1889 | Focken . | |
| 410,815 | 9/1889 | Tarbell . | |
| 416,096 | 11/1889 | Dom | 269/166 |
| 491,633 | 2/1893 | Bourassa . | |
| 678,805 | 7/1901 | Weyland | 269/203 |
| 749,732 | 1/1904 | Hanson et al. . | |
| 757,166 | 4/1904 | Wintsch | 269/171.5 |
| 775,659 | 11/1904 | Jorgensen . | |
| 792,758 | 6/1905 | Colt . | |
| 927,067 | 7/1909 | Offineer . | |
| 934,589 | 9/1909 | Bradford . | |
| 1,241,215 | 9/1917 | Hoffman . | |
| 1,340,092 | 5/1920 | Tuscher, Jr. . | |

(List continued on next page.)

FOREIGN PATENT DOCUMENTS

| | | |
|---|---|---|
| 225561 | 4/1959 | Australia . |
| 54742 | 6/1990 | Taiwan . |

OTHER PUBLICATIONS

"Pony Steel Bar Clamp Fixtures" styles 50, 52 and 56. Publication source and date unknown. It is believed that this publication was available to the public prior to Jul. 15, 1993.

Bessey Steel Bar Clamp Fixture RS 75 instructions. Publication source and date unknown. It is believed that this publication was available to the public prior to Jul. 15, 1993.

Advertisement for Bessey Bar Clamps Styles 52, 53 and 56. Publication source and date unknown. It is believed that this publication was available to the public prior to Jul. 15, 1993.

Advertisement for Bessey Bar Clamps Styles 43 and 45. Publication source and date unknown. It is believed that this publication was available to the public prior to Jul. 15, 1993.

Advertisement for Gross Stabil Clamp. Publication source and date unknown. It is believed that this publication was available to the public prior to Jul. 15, 1993.

"Pony Clamp Fixtures" styles 50, 52, 53 and 56. Jorgensen Style 3500 Aluminum Bar Clamps. Jorgensen Style 7200 Steel I–Bar Clamps. Publication source and date unknown. It is believed that this publication was available to the public prior to Jul. 15, 1993.

*Primary Examiner*—Robert C. Watson

*Attorney, Agent, or Firm*—Brinks Hofer Gilson & Lione

[57] ABSTRACT

A clamp structure that has a jaw mounted on a shaft with the clamping face of the jaw facing along the direction of the shaft and offset from it applies clamping force to a work piece when a cam that is part of the clamp structure is moved by an actuator from a free position to a clamping position. The cam is connected to the shaft and has a cam surface that applies force to a follower in opposition to a biasing spring when the actuator is so moved, and a mounting device holds the shaft between the follower and the spring.

102 Claims, 3 Drawing Sheets

U.S. PATENT DOCUMENTS

| | | | |
|---|---|---|---|
| 1,393,766 | 10/1921 | Du Charme . | |
| 1,402,621 | 1/1922 | Knittel et al. . | |
| 1,452,753 | 4/1923 | Otto et al. | 269/166 |
| 1,543,197 | 6/1925 | Ulrich . | |
| 1,583,611 | 5/1926 | Seely . | |
| 1,639,561 | 8/1927 | Hargrave | 269/171.5 |
| 1,783,713 | 12/1930 | Holman . | |
| 1,811,518 | 6/1931 | Palmer . | |
| 1,890,042 | 12/1932 | Morandi . | |
| 2,133,892 | 10/1938 | Gelinski . | |
| 2,157,345 | 5/1939 | Nelson . | |
| 2,468,358 | 4/1949 | Clark | 269/45 |
| 2,656,864 | 10/1953 | Hopfeld . | |
| 2,781,803 | 2/1957 | Nelson . | |
| 2,815,053 | 12/1957 | Walker . | |
| 2,815,778 | 12/1957 | Holman . | |
| 2,923,334 | 2/1960 | Brennan, Jr. . | |
| 2,949,947 | 8/1960 | Story . | |
| 3,033,559 | 5/1962 | Lindholm . | |
| 3,159,393 | 12/1964 | Villano . | |
| 3,173,674 | 3/1965 | Ringle . | |
| 3,331,111 | 7/1967 | Carver . | |
| 3,575,405 | 4/1971 | Harding . | |
| 3,596,898 | 8/1971 | Hilburn . | |
| 3,806,107 | 4/1974 | Pitzer et al. . | |
| 3,914,830 | 10/1975 | Bolton . | |
| 3,933,346 | 1/1976 | Carver . | |
| 3,963,230 | 6/1976 | Jankowski, Jr. . | |
| 4,042,264 | 8/1977 | Shumer . | |
| 4,078,781 | 3/1978 | Fraser et al. . | |
| 4,083,548 | 4/1978 | Hackbarth . | |
| 4,088,313 | 5/1978 | Pearson . | |
| 4,132,397 | 1/1979 | Ward . | |
| 4,143,869 | 3/1979 | Paterson et al. | 269/166 |
| 4,306,710 | 12/1981 | Vosper . | |
| 4,339,113 | 7/1982 | Vosper . | |
| 4,381,105 | 4/1983 | Goff et al. | 269/171 |
| 4,563,921 | 1/1986 | Wallace . | |
| 4,874,155 | 10/1989 | Goul . | |
| 4,893,801 | 1/1990 | Flinn . | |
| 4,926,722 | 5/1990 | Sorensen et al. . | |
| 4,989,847 | 2/1991 | Chapman . | |
| 5,009,134 | 4/1991 | Sorensen et al. . | |
| 5,094,131 | 3/1992 | Sorensen et al. . | |
| 5,096,170 | 3/1992 | Albin . | |
| 5,156,508 | 10/1992 | Grisley . | |
| 5,161,787 | 11/1992 | Hobday . | |
| 5,197,360 | 3/1993 | Wooster, Jr. . | |
| 5,222,420 | 6/1993 | Sorensen et al. . | |
| 5,346,194 | 9/1994 | Coffin | 269/166 |
| 5,443,246 | 8/1995 | Peterson . | |
| 5,454,551 | 10/1995 | Hobday . | |

CLAMP STRUCTURE

This is a continuation of application, Ser. No. 092,363, filed Jul. 15, 1993 now abandoned.

BACKGROUND OF THE INVENTION

1. Field of the Invention

This invention relates to the field of clamps and particularly to pipe clamps suitable for use in carpentry and woodworking but not limited to those uses.

2. The Prior Art

A wide variety of clamps have a jaw that is mounted near one end of an elongated shaft and has a clamping face that can be moved at least incrementally in the longitudinal direction of the shaft to exert holding pressure on a work piece. In most such clamps, there is a second jaw juxtaposed with respect to the first-named jaw and connected to the shaft so as not to move along it, at least while the holding pressure is being exerted. The second jaw also has a clamping face, and pressure on the work piece is developed between the clamping faces of the two jaws.

The clamping face is defined as being on the front surface of the respective jaw and is typically offset to one side of the shaft. In some clamps, one jaw is permanently affixed to a specific location along the shaft, usually at one end thereof, and the other jaw is movable to at least certain specific locations spaced from the other jaw according to the general size of the work piece to be clamped. In other clamps, both jaws may be moved. In any case, the clamp has engagement means by which each movable jaw is clamped at a selected location, after which the clamping face of at least one of the jaws is moved incrementally forward toward the clamping face of the other jaw until both clamping faces engage the work piece and exert sufficient pressure on the work piece to hold it rigidly in place.

One way to cause either jaw to become fixed in a selected location on the shaft is to provide it with a channel that runs through it and has first and second engagement surfaces at the front and rear ends, respectively, of the channel. The cross-sectional size of the channel in both directions is enough greater than the cross-sectional dimension of the shaft to allow that jaw to be moved easily along the shaft, but the dimension in the direction in which the clamping face is offset from the shaft is a little greater still, making it possible for the jaw to rock, slightly, about an axis perpendicular to the plane that includes the longitudinal direction of the shaft and the direction of offset of the clamping face from the shaft. The engagement surfaces at opposite ends of the channel are on opposite sides of the shaft and are arranged so that the engagement surface nearer the front end is on the opposite side of the shaft from the clamping face, while the engagement surface nearer the rear end of the channel is on the same side of the shaft as the clamping face. In some clamps, several pairs of engagement surfaces are provided by incorporating in the jaw a stack of sheet metal members, each of which can be considered to constitute an increment of the channel.

The loose fit of the channel on the shaft allows the movable jaw to be rocked slightly about the aforesaid axis when the clamping face of that jaw is forced tightly against the work piece, and this causes the engagement surfaces to be pressed against the shaft in a direction that dramatically increases the coefficient of friction of the movable jaw relative to the shaft and locks that jaw fixedly in place on the shaft. This locking force increases as the clamping pressure on the work piece is increased by incremental forward movement of one of the clamping faces as a result of operation of pressurizing means in the form of screw adjustment means or lever action or direct cam action after contact has been established between the clamping faces of the jaws and the work piece.

Some of the known clamps use standard iron pipe of any desired length as an inexpensive form of the shaft on which the jaws are mounted. Such pipe clamps may be free of any support and can be applied to work pieces that cannot be conveniently moved to a supporting structure. However, the pipes can also be held in saddles rigidly attached to sawhorses or workbenches or the like to provide a more stable support for working on the work pieces. The saddles have set screws that can be backed off to allow the pipe to be rotated to any desired position to give maximum access to work pieces gripped in such clamps, after which the set screws can be tightened to hold the pipe rigidly in that position.

OBJECTS AND SUMMARY OF THE INVENTION

It is an object of this invention to provide a clamp structure having a jaw mounted on a clamp shaft and having resilient means by which clamping pressure derived from cam means causes the clamping surface of the jaw to move, relative to the shaft, between free and clamping positions.

Still another object is to provide a method of gripping a work piece held in a fixed position relative to a shaft by drawing the shaft in a direction to pull the work piece against a clamping face on the jaw and, simultaneously, applying to the jaw resilient stress opposed to such pulling.

A further object is to provide a clamping structure of the foregoing type using a round pipe as the shaft supported by brackets mounted on a stable base, such as the cross bar of a sawhorse, with the resilient means between one of the brackets and the first jaw and with the jaws free to rotate on the pipe, prior to appliance of clamping pressure, so that they can be placed at any angle within a wide angular range to hold a work piece in any of an equally wide range of angles for easy access.

Those who are skilled in the technology with which this invention deals will recognize further objects after studying the following description.

In accordance with this invention, a clamp structure is provided that comprises: an elongated clamp shaft; a jaw mounted on the shaft and comprising a clamping face laterally offset a pre-determined distance from the shaft and facing in a first direction parallel to the shaft; cam means comprising cam surface means; connection means connecting the cam means to the shaft to allow the cam means to move, relative to the shaft, between free and clamping positions; cam follower means operatively connected to the cam surface means to be moved thereby in response to movement of the cam means; resilient means operatively connected between the cam follower means and the jaw; and cam actuating means to move the cam surface means from a first position to a second position to stress the resilient means to urge the clamping face toward a clamping position to exert pressure on a work piece.

The clamp structure may include a second jaw mounted on an extension portion of the clamp shaft and, like the first jaw, comprising a clamping face offset laterally a predetermined distance in a selected direction from the extension portion. Pressurizing means connected to the first jaw and to the clamp shaft and movable from a first position to a second position pull the second clamping face against a work piece placed between the clamping faces of the two jaws and pull the work piece, in turn, against the first jaw. Once these three components are rigidly locked together by this pulling, further pressure in the same direction by the pressurizing means stresses the resilient means, which presses the first jaw against the work piece to maintain the clamping force of the two jaws against opposite sides of the work piece.

In a preferred embodiment, the second jaw has front and rear sides spaced apart in the direction of movement of that jaw along an extension portion of the clamp shaft, and it also has a channel to receive the extension portion of the clamp shaft and to allow the second jaw to be positioned longitudinally along that shaft. The channel has a width in the selected direction greater than the width, in the selected direction, of the extension portion of the clamp shaft to allow the second jaw to be rocked on the extension portion of the clamp shaft. In addition, the second jaw has a first locking surface along one side of the channel remote from the second pressure surface and adjacent the front side of the jaw, and a second locking surface along the opposite side of the channel from the first locking surface and adjacent the back side of the jaw, the one side of the channel being closer to the second pressure surface than the opposite side of the channel, whereby pressure on the second surface rocks the first and second locking surfaces against opposite sides of the extension of the clamp shaft, thereby locking the second jaw into a fixed position along the extension of the clamp shaft by creating an extremely high coefficient of friction of the second jaw along the shaft.

The invention will be described in greater detail in connection with the drawings, in which like serial numbers in different figures indicate the same item.

DETAILED DESCRIPTION OF A PREFERRED EMBODIMENT

Figure 1:
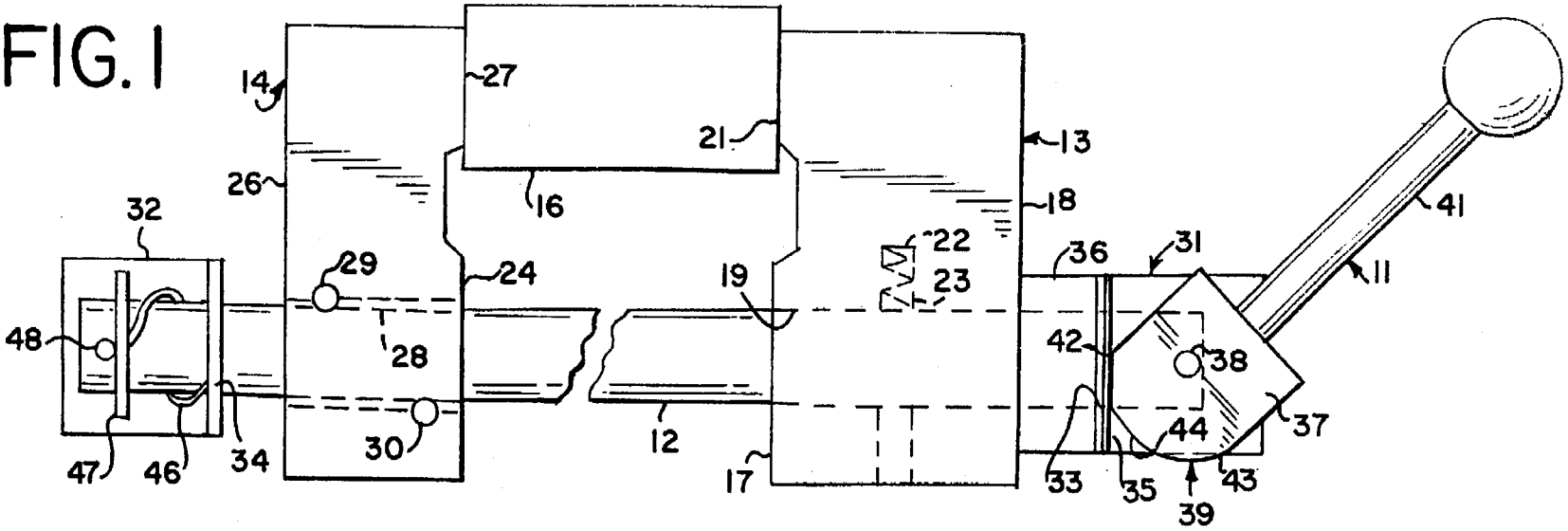
FIG. 1 is a front elevational view of one embodiment of a clamp structure according to this invention.

FIG. 1 shows a clamp structure 11 that includes a clamp shaft 12 on which are first and second jaws 13 and 14, both of which are basically pieces of wood in this embodiment, although they could be made of metal or other material. A block 16 representing a typical work piece to be held by the clamp is shown between the jaws.

In this embodiment the shaft 12 is a ¾" #40 round black iron pipe, although other materials and other cross-sectional configurations may be used instead. For example, if it is required that the pipe have greater strength, #80 pipe may be used instead, but these are not the only materials that may be used for the clamp shaft. The pipe 12 used in this embodiment has an external diameter of 1" and may be cut to any desired length, depending on the work pieces on which the clamp is expected to be used. A common length suitable for use if the clamp is to be mounted on a sawhorse of standard size is about 39".

The surface 17 of the jaw 13 that faces the jaw 14 is referred to as the front surface, and the surface 18 on the other side of the jaw 13 is the rear surface. A channel 19 of large enough cross-sectional area to allow the jaw 13 to slide freely on the shaft 12 extends through the jaw from the front surface to the rear surface. A clamping face 21 is on the front surface 17 and is offset from the shaft by a certain distance in a certain direction, which in this figure, is the upward direction. The jaw 13 has a blind hole 22, and a spring 23 is secured in that hole by the shaft 12 to exert enough frictional pressure on the shaft to keep the jaw from rotating freely, since it is frequently desired that it stand upright in the position shown rather than to hang down in the opposite position after rotating 180° around the round shaft 12.

The jaw 14 is much like the jaw 13 in its overall shape, and it is free to slide along what may be referred to as an extension portion of the shaft 12 to accommodate work pieces 16 of any width. It has a front surface 24 facing the jaw 13, a rear surface 26, and a clamping face 27 on the front surface. The work piece 16 between the jaws is, in fact, shown positioned between the clamping faces 21 and 27. The jaw 14 also has a channel 28 that passes through from the front surface to the rear surface thereof, but the channel 28 is slightly wider in one direction parallel to the plane of the drawing, i.e., in the direction in which the clamping face 27 is offset from the channel, than in the direction perpendicular to the plane of the drawing. This allows the jaw 14 to rock slightly about an axis perpendicular to the plane common to the axis of the shaft 12 and to the direction in which the clamping face is offset from the channel.

Two engagement means 29 and 30 are pins securely inserted in slightly undersized holes in the jaw 14 and spaced apart so that, when the shaft 12 is substantially perpendicular to the front surface 24, these pins just touch opposite sides of the shaft. When the jaw 14 is rocked counterclockwise by having the clamping face 27 pushed to the left, as happens when the jaws 13 and 14 are caused to exert clamping pressure on the work piece 16, the pin 29 presses down on the top surface of the shaft 12 and the pin 30 presses up on the bottom surface. This causes both pins to dig into the respective surfaces of the shaft, if only microscopically, and prevents the jaw 14 from being pushed to the left.

L-shaped brackets 31 and 32, which may be identical, can be used to attach the clamp structure 11 to a support member (not shown in FIG. 1), although the clamp can be used free of any support. The brackets have holes 33 and 34 that are just large enough to allow the shaft to slide easily in them, and a hardened thrust washer 35 encircles the shaft 12 on one side of the bracket 31 to absorb the thrust of a cam 37 mounted on a pivot pin 38. The washer is therefore referred to hereinafter as a cam follower. If it were not located between the cam and the bracket 31, the cam would press on the bracket, which would then serve as the cam follower. It is advantageous to have the washer as the cam follower 35, both to protect the bracket and to serve as the only cam follower if the clamp structure 11 is removed from the brackets 31 and 32 and used free of any support.

A resilient member 36 is operatively connected to the jaw 13 and to the cam follower 35 to resist any movement of the jaw toward the cam 37 and, in this embodiment, is in the form of a short tube of elastomeric material surrounding the shaft 12 between the jaw 13 and the bracket 31 and serving as a compression spring.

The pivot pin 38 is inserted through the shaft 12 near the right-hand end thereof beyond the bracket 31, and the cam 37, which is in the form of a U-shaped structure with two identical, parallel flanges, is mounted on the pin so that the two flanges straddle the shaft 12. One of these flanges is directly behind the other, and since they are identical, the shape and operation of the cam will be described as if there were only one flange. The edge of the flange defines cam surface means 39, and a handle 41 is attached to the cam to pivot it about the pin 38.

The cam surface has a first portion 42 at a first angular location, a second portion 43 at a second angular location, and a third portion 44 extending over and angular range between the first and second angular locations. As the cam 37 pivots on the pin 38, each of these portions bears against the hardened surface of the cam follower 35, first the portion 42, then the portion 44, and finally, the portion 43. The first portion 42 is relatively flat and is at a relatively small radial distance from the axis of the pivot pin 38, and when this portion is in contact with the cam follower 35, as it is in FIG. 1, the pivot pin 38 is as close as it ever gets to the cam follower. The second portion 43 is also relatively flat, but is at a greater radial distance from the axis. The third portion 44 has a continuously increasing radius over a range of angular locations between the first and second angular locations, the largest radius of the third portion being close to the second angular location and slightly greater than the radial distance from the axis to the second portion 43.

Unlike cams in which the axis of rotation of the cam remains stationary and the position of the follower moves toward and away from it according to the radius of the part of the cam surface that happens to be in contact with the follower at any instant, the cam follower 35 remains stationary against the bracket 31 at all times, and the pivot pin moves toward and away from the cam follower according to the part of the cam surface 39 in contact with the cam follower. The significance of this movement can best be understood by considering the sequence of actions that takes place in clamping the work piece 16 between the clamping faces 21 and 27.

The initial step is to move the jaw 14 along the shaft 12 by hand to the right until its clamping face 27 makes contact with the work piece and the work piece makes contact with the clamping face 21 of the jaw 13. At this time, with the handle 41 in the position shown in FIG. 1, the cam 37 is in its free position with the first portion 42 in contact with the cam follower 35, and the resilient member 36 is unstressed, i.e., it has not started to be compressed between the jaw 13 and the bracket 31.

In order to apply clamping pressure to the work piece, clockwise pivotal movement of the handle 41 is started, causing the cam 37 to start to pivot and bringing the curved, third portion 44 of the cam surface 39 into contact with the cam follower 35. This initial movement of the cam 37 causes the pivot pin to start to draw the shaft 12 to the right, thereby pulling the clamping face 27 of the jaw 14 against the work piece 16 and rocking that jaw counterclockwise, at least enough to cause the engagement means 29 and 30 to lock rigidly on the shaft 12.

Further pivoting of the handle 41 to pivot the cam 37 moves the portion 44 of increasing radius across the surface of the cam follower 35, thereby increasing the pressure of the clamping face 27 on the work piece and pressure of the work piece on the clamping face 21 of the jaw 13 until just before the cam reaches the position in which the second portion 43 of the surface 39 is in contact with the cam follower. This increasingly compresses the resilient member 36 to its maximum amount, until the handle is about 90° from the free position. In the final increment of the movement of the handle, the portion 43 finally comes into contact with the cam follower 35, and the resilient member relaxes slightly, enough to hold the cam in its clamping position.

A typical clamping pressure for use in carpentry is on the order of 300 lbs., but this should not be considered as a limitation of the invention. A suitable resilient member 36 for use in a carpenter's clamp is an annular tube about 1" long of about 75–85 durometer, preferably about 80 durometer, rubber or urethane having an internal diameter of about 1.1" and an external diameter of about 1.7", but helical wire springs and other types of springs can be used instead.

When the clamping pressure is to be released, the handle 41 is rotated counterclockwise, back to the position shown in FIG. 1. This allows the resilient member 36 to return to its unstressed size, provided the shaft 12 moves back to the left. In order to insure that movement, a relatively weak compression spring 46 encircles the shaft 12 on the left side of the bracket 32 and is held between the bracket and a retainer washer 47 that is, in turn, prevented by a pin 48 from sliding off of the left-hand end of the shaft. The spring 46 was compressed by movement of the shaft 12 to the right, and movement of the cam 37 back to the position shown in the drawing frees the shaft to be pushed to the left by action of the spring 46 against the retainer 47. This movement of the shaft is in the direction to unlock the engagement means 29 and 30 from the shaft, thereby releasing clamping pressure on the work piece, which can then be removed from the clamp structure 11.

Figure 2:
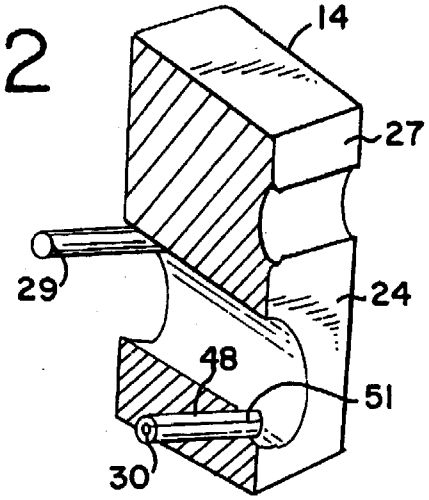
FIG. 2 is a perspective cross-sectional view of one of the jaws in FIG. 1 showing the engagement means in greater detail.

FIG. 2, which is a perspective view of one half of the jaw 14 cut along its central vertical plane, shows two illustrative examples of the engagement means, or pins, 29 and 30. Normally, these pins 29 and 30 would both be of the same type, but the pin 29 in this figure is a knurled pin and the pin 30 is a roll pin. The relatively sharp flutes of a knurled pin dig into the surface of the shaft 12 farther than would a smooth, round pin of the same diameter and thus create a still greater increase in the effective coefficient of friction between the pin 29 and the shaft 12.

The major part of the cylindrical surface of the roll pin 30 is smoother than the surface of the knurled pin 29 and would not produce as high an effective coefficient of friction as the knurled pin 29. However, by orienting the roll pin 30 so that its edges 49 and 51 face the shaft 12, these edges do serve the same purpose as the flutes of the knurled pin 29 and produce the same increase in the effective coefficient of friction.

Figure 3:
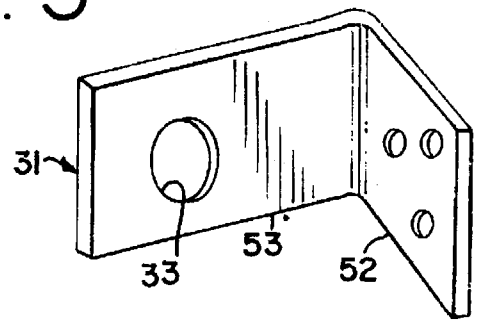
FIG. 3 is a perspective view of one form of bracket that can be used in the clamp structure in FIG. 1.

FIG. 3 shows the complete L-shaped bracket 31 as having a base 52 with several mounting holes though which screws or other fasteners can be inserted to affix the bracket to a rigid base. The bracket 31 also has an upright part 53 perpendicular to the base 52, and the hole 33 is located in this part of the bracket.

Figure 4:
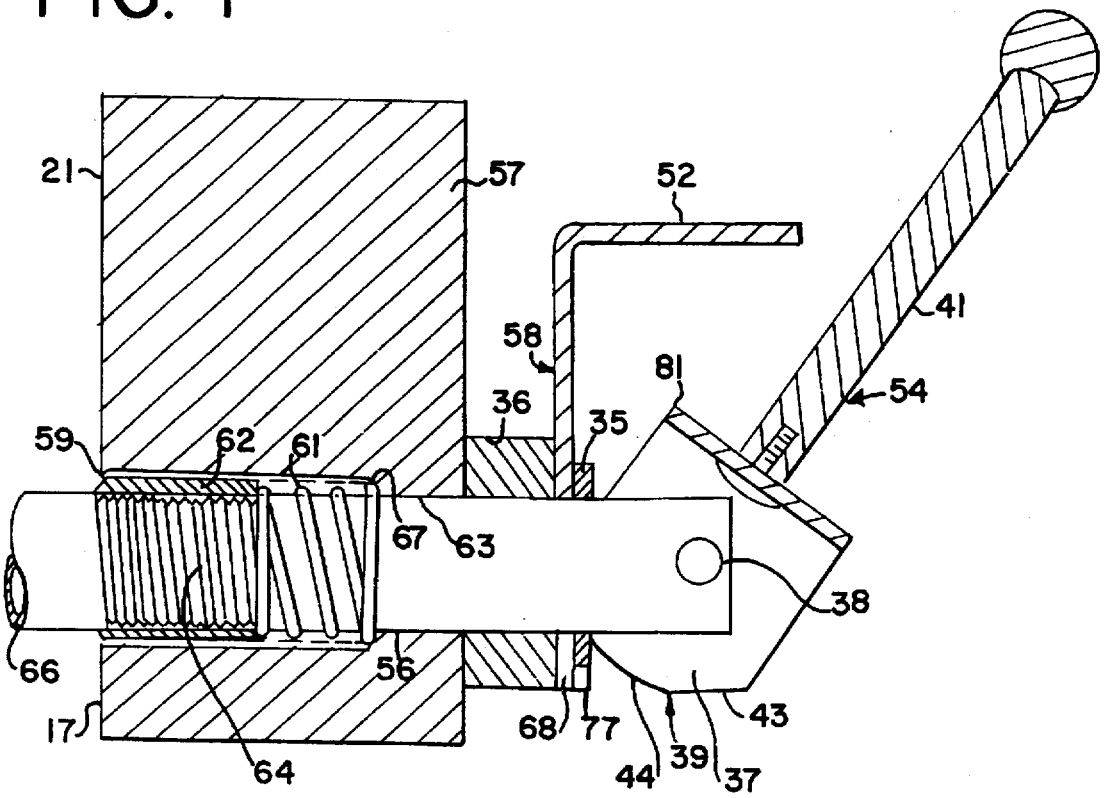
FIG. 4 is a cross-sectional view of another embodiment of a clamp structure according to the invention.

The cross-sectional view in FIG. 4 shows the essential features of a modified clamp structure 54 that has many parts in common with the clamp structure 11 in FIG. 1. Those parts will be identified by the same reference numerals, and their operation will not be described again.

The main differences between the clamp shown in FIG. 4 and the corresponding parts of the clamp structure 11 in FIG. 1 are in a clamp shaft 56, a clamp jaw 57, and a bracket 58 to support the clamp shaft. The cam 37, including its handle 41 and cam surface 39, as well as the pivot pin 38, the hardened thrust washer 35 that serves as a cam follower, and the resilient member 36 are all identical to those same parts in FIG. 1.

The jaw 57 differs from the jaw 13 in that its channel has two different diameters: a larger diameter section 59 on the forward end to accommodate a compression spring 61 and a coupling 62, and a smaller diameter section 63 that is only large enough to allow the clamp shaft 56 to slide freely therein. The clamp shaft 56 may be made of the same iron pipe or other material as the clamp shaft 12 in FIG. 1, and it may have the same diameter. Consequently, the diameter of the section 63 can be the same as the diameter of the channel 19 in the jaw 13 in FIG. 1.

The end 64 of the shaft 56 within the jaw 57 is externally threaded, and the coupling 62 is internally threaded to fit on the threaded end 64. The dimensions are such that the shaft 56 terminates at about the midpoint of the coupling, and, when the spring 61 is not compressed, the left-hand end of the coupling extends slightly from the front surface 17 of the jaw 57. A shaft 66, only a small part of which is shown, is screwed into the left-hand end of the coupling 62. This shaft will be referred to as an extension shaft, since it serves as an extension portion of the shaft 56, and it may be of any length so as to accommodate any work piece, and it need not be sold as part of the clamp structure but can be purchased separately. The extension shaft 66 can accommodate a second jaw or some other device to develop a clamping force against the clamping face 21 of the jaw 57 when the handle 41 is actuated to pull the shaft 56 and the extension shaft 66 to the right relative to the positions in which they are shown in FIG. 4.

The components of the clamp structure 54 illustrated in FIG. 4, other than the extension shaft 66, can be more conveniently packaged for sale than if it were necessary to include in the package a relatively long piece of pipe, such as the shaft 12 in FIG. 1.

The larger diameter section 59 of the channel through the jaw extends far enough into the jaw to accommodate the compression spring 61 between the right-hand end of the coupling and a shoulder 67 formed where the diameter of the channel suddenly reduces from that of the larger diameter section 59 to that of the smaller diameter section 63. This spring provides enough friction to prevent the jaw 57 from swiveling on the shaft 56 and thus serves the same purpose as the spring 23 in FIG. 1. In addition, the spring 61 pushes the shaft 56 and the extension shaft 66 to the left when clamping pressure is released and thus serves the same purpose as the spring 46 in FIG. 1. As a result, it is not only possible to leave off the spring 46 but the retainer 47 and the pin 48 of FIG. 1.

Figure 5:
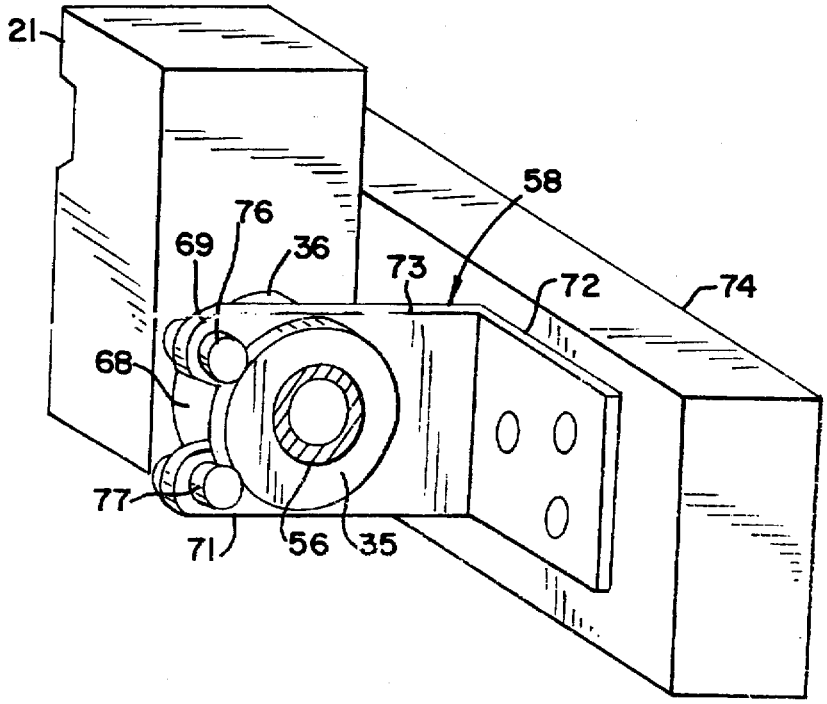
FIG. 5 is a perspective view of part of the clamp structure in FIG. 4.

FIG. 5 shows only part of a clamp structure, which may be either the clamp structure 11 in FIG. 1 or the clamp structure 54 of FIG. 4. In order to show the bracket 58 more clearly, the shaft 56 has been cut off so that one end is coplanar with the surface of the cam follower 35 that faces the cam and is pressed against the cam. The cam, itself, and the end of the shaft 56 on which it is mounted are not shown in this figure. Unlike the brackets 31 and 32 in FIG. 3, the bracket 58 has a notch 68 defined by two arms 69 and 71 spaced apart a distance only slightly larger than the diameter of the shaft 56 so that the latter can slide as easily therein as it does in the hole in the bracket 31 in FIG. 3. The bracket 58 has a base 72 and an upright portion 73 and is shown mounted on a support 74, such as the horizontal beam of a sawhorse, and the depth of the notch 68 is such that, when the shaft 56 is pressed into the notch as far as possible, the shaft 56 will be at the same distance from the support 74 as it would be if the shaft were held by the bracket 31. Thus, the shaft 56 and its extension portion 66, when supported by the bracket 58 and the bracket 32, will be held parallel to the support 74.

The cam follower 35 is prevented from sliding out of the notch 68 by two projections 76 and 77 at the outer ends of the arms 69 and 71. These projections are located to hold the cam follower 35 so that the latter, in turn, will hold the shaft 56 at the full depth of the notch 68.

Figure 6:
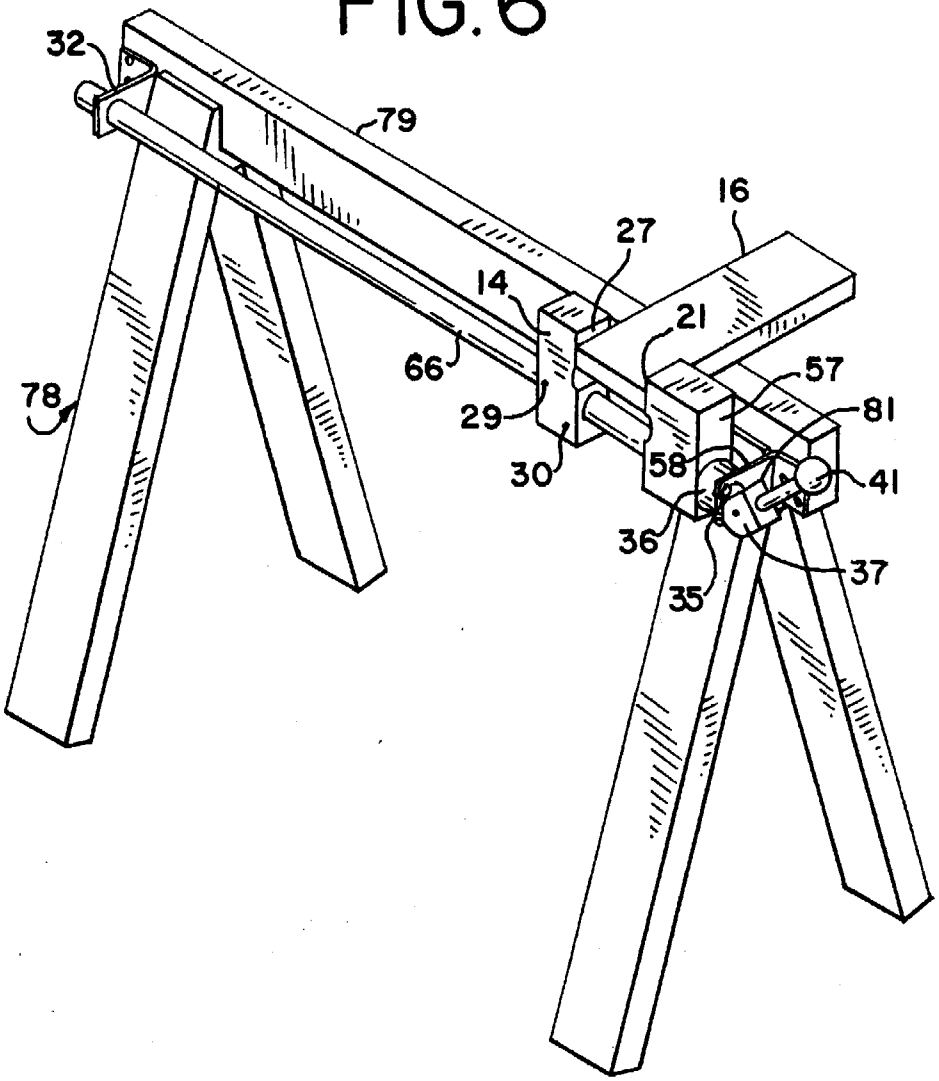
FIG. 6 is a perspective view of part of one of the brackets in FIG. 4 attached to a sawhorse.

FIG. 6 shows a sawhorse 78 with the clamp structure 54 of FIG. 4 attached to its horizontal beam 79 as a support, although the clamp structure could just as easily be the clamp structure 11 of FIG. 1. When the brackets 32 and 58 are bolted onto the horizontal beam 79, it is desirable that they be placed so that the clamping faces 21 and 27 of the jaws 57 and 14 extend just far enough above the top of the beam to allow the work piece 16 to rest on the beam. If the work piece is very long, a second sawhorse may be used to support one end of it. It is normally not necessary to use a second clamping structure on the second sawhorse, although that may be done if desired.

Both of the jaws can be pivoted around their respective, co-linear shafts 56 and 66 to accommodate not only work pieces that rest on the beam 79 but also work pieces that are easier to work on if they are clamped so that they stand vertically. Still other work pieces may be more accessible if they lean upon the beam 79 while keeping one end on the ground. Whatever the preferred orientation of the work piece, the clamping structures 11 and 54 can accommodate it.

The work piece 16 shown in FIG. 6 is relatively narrow, but the clamp structure 54 (or 11) can handle much wider work pieces, such as doors and the like. In theory there is no limit to the length of the extension shaft 66 or to the shaft 12 in FIG. 1.

Figure 7:
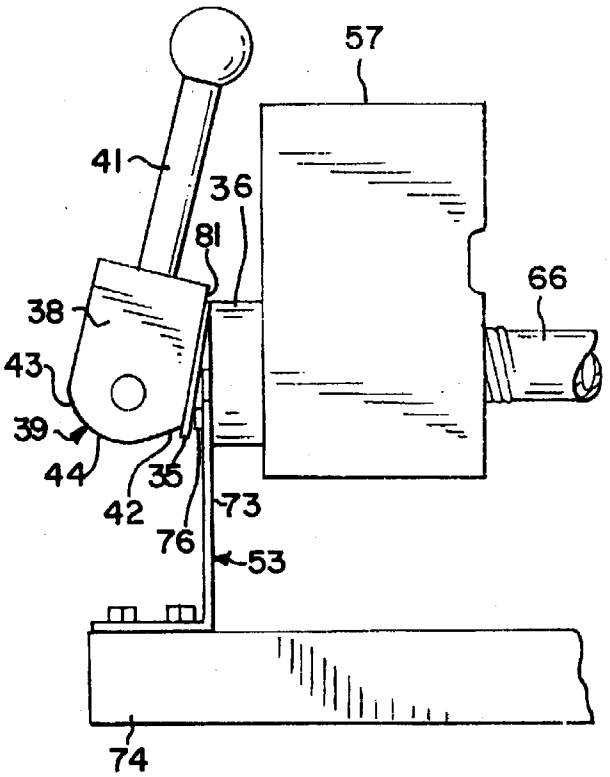
FIG. 7 shows the clamp structure in FIG. 4 being manipulated to attach it to or remove it from the bracket in FIG. 6.

There are occasions when it is desirable to use the clamp structure by itself, away from a support. This can be easily accomplished by manipulating the handle 41 of the clamp structure 54 into the position shown in FIG. 7. In this position, the cam 37 is forced beyond the free position in which the first portion 42 of the cam surface 39 rests against the surface of the cam follower 35 and into a position in which a part 81 of the cam is pressed against the cam follower hard enough to compress the upper part of the resilient member 36 sufficiently to lever the cam follower 35 far enough away from the upright portion 73 of the bracket 58 to clear the projections 76 and 77. These projections are only about as high as the cam follower washer 35 is thick. Once the cam follower is free to get over these projections, the shaft 56 can be pulled in the longitudinal direction of the arms 69 and 71 and thus be pulled free of the bracket 58. Once free, the clamp structure 54, when it has a second jaw mounted on the extension shaft 66, can be used like a standard pipe clamp. Without the second jaw, the clamp structure 54 can be used as a single-jawed clamp, for example by threading the extension shaft 66 into a work piece and pulling it toward the clamping face 21.

What is claimed is:

1. A clamp structure comprising:

(a) a clamp shaft extending along a longitudinal direction;

(b) a jaw mounted on the shaft and comprising a clamping face laterally offset a predetermined distance from the shaft and facing in a first direction parallel to the shaft;

(c) a cam comprising a cam surface;

(d) a connector connecting the cam to the shaft to allow the cam to move, relative to the sham, between free and clamping positions;

(e) a cam follower operatively connected to the cam surface to be moved there by in response to movement of the cam;

(f) a mounting structure to hold the shaft;

(g) a cam actuator to move the cam surface from a first position to a second position to stress the resilient member to urge the clamping face toward a clamping position to exert pressure on a work piece; and (h) a second jaw having a channel to receive said clamp shaft so as to mount said second jaw to said clamp shaft, wherein said channel has a shape that prevents substantial translational movement of said second jaw in a direction other than along said longitudinal direction.

2. The clamp structure in accordance with claim 1 in which the connector comprises a pivot member on which the cam is mounted.

3. The clamp structure in accordance with claim 2 in which the pivot member is mounted on the clamp shaft.

4. The clamp structure in accordance with claim 1 in which the cam follower comprises an apertured plate, the clamp shaft being threaded through the plate.

5. The clamp structure in accordance with claim 1 in which the connector comprises a pivot member on the clamp shaft, the cam being pivotally mounted on the pivot member, and the cam surface comprises an arcuate surface having a first portion at a first angular location, a second portion at a second angular location, and a third portion of continuously increasing radius over a range of angular locations between the first and second angular locations, whereby the cam surface exerts increasing pressure on the cam follower to urge the clamping face toward the clamping position as the cam is pivoted in one direction from a position in which the first portion engages the cam follower to a second position in which the second portion engages the cam follower.

6. The clamp structure in accordance with claim 5 in which the cam surface comprises a substantially flat portion at the first angular location to hold the cam follower in a free position.

7. The clamp structure in accordance with claim 6 in which the cam surface comprises a second substantially flat portion at the second angular location to hold the cam follower in a pressurizing position.

8. The clamp structure of claim 1, comprising a resilient member operatively connected between the cam follower and the jaw.

9. The clamp structure of claim 8, wherein said resilient member is stressed by said cam actuating member so that the resilient member urges said clamping face toward said clamping position.

10. The clamp structure in accordance with claim 8 in which the resilient member is located between the cam follower and the jaw.

11. The clamp structure in accordance with claim 10 in which the resilient member is threaded on the clamp shaft.

12. The clamp structure in accordance with claim 11 in which the resilient member comprises an annular tube of elastomeric material.

13. The clamp structure in accordance with claim 12 in which the elastomeric material has a durometer rating between about 75 and 85.

14. The clamp structure in accordance with claim 13 in which the elastomeric material has a durometer rating of about 80.

15. A clamp structure comprising:

(a) a pipe having a longitudinal axis and a pre-determined external diameter;

(b) a first jaw mounted on the pipe and comprising a first clamping face laterally offset a pre-determined distance from the axis and facing in a first direction parallel to the pipe;

(c) a second jaw comprising:

(i) a front surface facing the first jaw and a rear surface facing away from the first jaw, (ii) a channel to receive the pipe, the channel having cross-sectional dimensions enough larger than the external diameter of an extension portion of the pipe to allow the second jaw to be moved longitudinally to selected positions along the pipe, (iii) a second clamping face facing the first clamping face and laterally offset from the axis in a certain direction by a distance substantially equal to the predetermined distance, the channel having a greater width in the certain direction than the diameter of the pipe, whereby the second jaw can be rocked to a limited extent about an axis perpendicular to the longitudinal axis of the pipe and to the certain direction, (iv) a first locking surface along one side of the channel remote from the second clamping face and adjacent the front surface of the second jaw, and (v) a second locking surface along the opposite side of the channel from the first locking surface and adjacent the rear surface of the second jaw, whereby pressure on the second clamping face rocks the first and second locking surfaces against opposite sides of the pipe and locks the second jaw into a fixed position along the pipe;

(d) a cam comprising a cam surface;

(e) a connector that movably connects the cam to the pipe;

(f) a cam follower between the cam surface and the first jaw;

(g) a cam actuator which moves the cam surface from a first position to a second position to shift the location of the pipe longitudinally from a free position to a clamping position to draw the second clamping face toward the first clamping face and against a work piece to rock the first and second locking surfaces against opposite sides of the pipe to lock the second jaw in fixed engagement with the pipe and against the work piece;

(h) a first resilient member engaging the pipe to urge the pipe toward the free position to move the second clamping face away from the work piece when the cam actuator moves the cam surface from the second position back to the first position.

16. The clamp structure of claim 15, comprising a second resilient member operatively connected to the cam follower and the first jaw to be stressed upon movement of said cam to the second position to exert pressure forcing said second jaw toward said first jaw.

17. The clamp structure in accordance with claim 16 comprising a support bracket for holding the pipe between the cam follower and the second resilient member, said support bracket comprising:

(a) a base portion; and (b) an upright portion having:

(i) a notch to receive the pipe, and (ii) a projection adjacent the notch to releasably hold the cam follower.

18. The clamp structure in accordance with claim 15 in which the connector is a pivot member pivotally supporting the cam on the pipe.

19. The clamp structure in accordance with claim 15 in which the cam follower comprises:

(a) a first bracket to attach the pipe to a support near one end of the pipe; and (b) a second bracket engaging the pipe between the other end thereof and the second jaw.

20. The clamp structure in accordance with claim 19 in which the first resilient member comprises:

(a) a compression spring encircling the pipe between the other end of the pipe and the second bracket; and (b) a retainer positioned on the pipe between said other end thereof and the compression spring to retain the compression spring.

21. The clamp structure in accordance with claim 15 in which:

(a) the first jaw comprises:

(i) a first surface facing the second jaw, (ii) a second surface facing in the opposite direction, (iii) a second channel extending through the first jaw from the first surface thereof to the second surface thereof; and (b) the first resilient member engaging the pipe comprises a compression spring surrounding the pipe within the channel through the first jaw, a first end of the compression spring being connected to the first jaw and a second end of the compression spring being connected to the pipe, whereby the compression spring is compressed when the pipe is drawn through the first jaw by operation of the cam.

22. The clamp structure in accordance with claim 21 in which the diameter of the second channel adjacent the second surface of the first jaw is large enough to allow the first jaw to slide on the pipe but smaller than the diameter of the second channel adjacent the first surface of the first jaw, the second channel having a step between the larger and smaller diameters, and the first end of the compression spring engaging the step.

23. The clamp structure in accordance with claim 22 in which the pipe comprises a coupling that extends outwardly from the pipe, and the second end of the compression spring engages the coupling within the second channel.

24. The clamp structure in accordance with claim 23 in which the coupling has an external diameter less than the diameter of the channel adjacent the second end of the first jaw, whereby the coupling can fit into the channel adjacent the first surface of the first jaw.

25. A clamp structure comprising:

(a) a clamp shaft;

(b) a jaw mounted on the shaft and comprising:

(i) a front clamping face facing in a first direction parallel to the shaft;

(ii) a rear surface facing in the opposite direction, and (iii) a channel extending through the jaw and having one end at the front surface and a second end at the rear surface, the shaft extending into the second end of the channel and terminating in the jaw, whereby one end of the shaft is within the jaw, the one end of the jaw comprising an attachment to attach an extension shaft thereto to extend out through the front surface.

(c) a cam comprising a cam surface;

(d) a connector connecting the cam to the shaft to allow the cam to move, relative to the shaft, between free and clamping positions;

(e) a cam follower operatively connected to the cam surface to be moved thereby in response to movement of the cam;

(f) a mounting structure to hold the shaft and (g) a cam actuator to move the cam surface from a first position to a second position to urge the clamping face toward a clamping position to exert pressure on a work piece.

26. The clamp structure in accordance with claim 25 in which the clamp shaft is a round cylinder externally threaded at said one end, and the attachment comprises an internally threaded coupling screwed onto the externally threaded end of the clamp shaft.

27. The clamp structure in accordance with claim 26 in which the channel has a first diameter at its first end large enough to receive the coupling member and, at its second end, a smaller diameter only large enough to receive the shaft and allow the shaft to slide freely therein.

28. The clamp structure in accordance with claim 27 in which the channel has an internal shoulder between the first and second diameters, and the structure further comprises a compression spring surrounding the shaft within the channel and captured between the shoulder and the coupling member.

29. The clamp structure of claim 25, comprising a resilient member operatively connected between the cam follower and the jaw.

30. A clamp structure comprising:

(a) a clamp shaft;

(b) a jaw mounted on the shaft and comprising a clamping face laterally offset a predetermined distance from the shaft;

(c) a cam comprising a cam surface;

(d) a connector connecting the cam to the shaft to allow the cam to move, relative to the shaft, between free and clamping positions;

(e) a cam follower operatively connected to the cam surface to be moved thereby in response to movement of the cam;

(f) a mounting structure to hold the shaft so that the shaft is aligned along a longitudinal direction;

(g) a cam actuator to move the cam surface from a first position to a second position by urging the clamping face toward a clamping position to exert pressure on a work piece; and (h) a second jaw having a channel to receive said clamp shaft so as to mount said second jaw to said clamp shaft, wherein said channel has a shape that prevents substantial translational movement of said second jaw in a direction other than along said longitudinal direction.

31. The clamp structure of claim 30, comprising a resilient member operatively connected between the cam follower and the jaw.

32. The clamp structure of claim 31, wherein said mounting structure is positioned between said cam follower and said resilient member.

33. The clamp structure of claim 30 wherein said mounting structure is integral with said cam follower.

34. The clamp structure of claim 30 wherein said mounting structure encircles the entire shaft.

35. The clamp structure of claim 34, wherein said mounting structure has an aperture through which said shaft is inserted therethrough.

36. The clamp structure of claim 35 wherein said mounting structure is integral with said cam follower.

37. The clamp structure of claim 35, comprising a resilient member operatively connected between the cam follower and the jaw.

38. The clamp structure of claim 37, wherein said mounting structure is positioned between said cam follower and said resilient member.

39. The clamp structure of claim 30 in which the connector comprises a pivot member on which the cam is mounted.

40. The clamp structure of claim 39 in which the pivot member is mounted on the clamp shaft.

41. The clamp structure of claim 30 in which the cam follower comprises an apertured plate, the clamp shaft being threaded through the plate.

42. The clamp structure of claim 41, comprising a resilient member operatively connected between the cam follower and the jaw.

43. The clamp structure of claim 42 in which the resilient member is located between the cam follower and the jaw.

44. The clamp structure of claim 43 in which the resilient member is threaded on the clamp shaft.

45. The clamp structure of claim 44 in which the resilient member comprises an annular tube of elastomeric material.

46. The clamp structure of claim 45 in which the elastomeric material has a durometer rating between about 75 and 85.

47. The clamp structure of claim 46 in which the elastomeric material has a durometer rating of about 80.

48. The clamp structure of claim 30 in which the connector comprises a pivot member on the clamp shaft, the cam being pivotally mounted on the pivot member, and the cam surface comprises an arcuate surface having a first portion at a first angular location, a second portion at a second angular location, and a third portion of continuously increasing radius over a range of angular locations between the first and second angular locations, whereby the cam surface exerts increasing pressure on the cam follower to urge the clamping face toward the clamping position as the cam is pivoted in one direction from a position in which the first portion engages the cam follower to a second position in which the second portion engages the cam follower.

49. The clamp structure of claim 48 in which the cam surface comprises a substantially flat portion at the first angular location to hold the cam follower in a free position.

50. The clamp structure of claim 49 in which the cam surface comprises a second substantially flat portion at the second angular location to hold the cam follower in a pressurizing position.

51. The clamp structure of claim 30 wherein said mounting structure encircles a portion of said shaft.

52. The clamp structure of claim 51, wherein said mounting structure has a notch through which said shaft is inserted therethrough.

53. A clamp structure comprising:

(a) a clamp shaft;

(b) a jaw mounted on the shaft and comprising a clamping face laterally offset a predetermined distance from the shaft;

(c) a cam comprising a cam surface;

(d) a connector connecting the cam to the shaft to allow the cam to move, relative to the shaft, between free and clamping positions;

(e) a cam follower operatively connected to the cam surface to be moved thereby in response to movement of the cam;

(f) a mounting structure to hold the shaft so that the shaft is aligned along a longitudinal direction;

(g) a cam actuator to move the cam surface from a first position to a second position by urging the clamping face toward a clamping position to exert pressure on a work piece;

wherein the jaw has a front surface, and rear surface, and a channel extending through the jaw and having one end at the front surface and a second end at the rear surface, the shaft extending into the second end of the channel and terminating in the jaw, whereby one end of the shaft is within the jaw, the one end of the jaw comprising an attachment to attach an extension shaft thereto to extend out through the front surface.

54. The clamp structure of claim 53 in which the clamp shaft is a round cylinder externally threaded at said one end, and the attachment comprises an internally threaded coupling screwed onto the externally threaded end of the clamp shaft.

55. The clamp structure of claim 54 in which the channel has a first diameter at its first end large enough to receive the coupling member and, at its second end, a smaller diameter only large enough to receive the shaft and allow the shaft to slide freely therein.

56. The clamp structure of claim 55 in which the channel has an internal shoulder between the first and second diameters, and the structure further comprises a compression spring surrounding the shaft within the channel and captured between the shoulder and the coupling member.

57. A clamp structure comprising:

(a) a pipe having a longitudinal axis and a pre-determined external diameter;

(b) a first jaw mounted on the pipe and comprising a first clamping face laterally offset a pre-determined distance from the axis;

(c) a second jaw comprising:

(i) a front surface facing the first jaw and a rear surface facing away from the first jaw, (ii) a channel to receive the pipe, the channel having cross-sectional dimensions enough larger than the external diameter of an extension portion of the pipe to allow the second jaw to be moved longitudinally to selected positions along the pipe, (iii) a second clamping face laterally offset from the axis in a certain direction by a distance substantially equal to the predetermined distance, the channel having a greater width in the certain direction than the diameter of the pipe, whereby the second jaw can be rocked to a limited extent about an axis perpendicular to the longitudinal axis of the pipe and to the certain direction, (iv) a first locking surface along one side of the channel remote from the second clamping face and adjacent the front surface of the second jaw, and (v) a second locking surface along the opposite side of the channel from the first locking surface and adjacent the rear surface of the second jaw, whereby pressure on the second clamping face rocks the first and second locking surfaces against opposite sides of the pipe and locks the second jaw into a fixed position along the pipe;

(d) a cam comprising a cam surface;

(e) a connector that movably connects the cam to the pipe;

(f) a cam follower between the cam surface and the first jaw;

(g) a cam actuator which moves the cam surface from a first position to a second position to shift the location of the pipe longitudinally from a free position to a clamping position to draw the second clamping face toward the first clamping face and against a work piece to rock the first and second locking surfaces against opposite sides of the pipe to lock the second jaw in fixed engagement with the pipe and against the work piece;

(h) a first resilient member engaging the pipe to urge the pipe toward the free position to move the second clamping face away from the work piece when the cam actuating means moves the cam surface from the second position back to the first position.

58. The clamp structure of claim 57, comprising a second resilient member operatively connected to the cam follower and the first jaw to be stressed upon movement of said cam to the second position to exert pressure forcing said second jaw toward said first jaw.

59. A clamp structure comprising:

(a) a clamp shaft;

(b) a jaw mounted on the shaft and comprising:

(i) a front clamping face;

(ii) a rear surface facing away from said front clamping face, and (iii) a channel extending through the jaw and having one end at the front surface and a second end at the rear surface, the shaft extending into the second end of the channel and terminating in the jaw, whereby one end of the shaft is within the jaw, the one end of the jaw comprising an attachment to attach an extension shaft thereto to extend out through the front surface;

(c) a cam comprising a cam surface;

(d) a connector connecting the cam to the shaft to allow the cam to move, relative to the shaft, between free and clamping positions;

(e) a cam follower operatively connected to the cam surface to be moved thereby in response to movement of the cam;

(f) a mounting structure to hold the shaft so that the shaft is aligned along a longitudinal direction; and (h) a cam actuator to move the cam surface from a first position to a second position by urging the clamping face toward a clamping position to exert pressure on a work piece.

60. The clamp structure of claim 59, comprising a resilient member operatively connected between the cam follower and the jaw.

61. A clamp structure comprising:

(a) a clamp shaft;

(b) a first jaw movably mounted on the shaft and comprising a clamping face;

(c) a second jaw comprising:

(i) a second clamping face;

(ii) a channel to receive said clamp shaft;

(iii) a first locking surface along one side of the channel remote from the second clamping face; and (iv) a second locking surface along the opposite side of the channel from the first locking surface, whereby pressure on the second clamping face rocks the first and second locking surfaces against opposite sides of the clamp shaft and locks the second jaw into a fixed position along the clamp shaft;

(d) a cam comprising a cam surface;

(e) a connector connecting the cam to the shaft to allow the cam to move, relative to the shaft, between free and clamping positions;

(f) a cam follower operatively connected to the cam surface to be moved thereby in response to movement of the cam; and (g) a cam actuator to move the cam surface from a first position to a second position by urging the clamping face toward a clamping position to exert pressure on a work piece.

62. The clamp structure of claim 61, comprising:

(h) a resilient member operatively connected between the cam follower and the jaw;

(i) a mounting structure to hold the shaft so that the shaft is aligned along a longitudinal direction.

63. The clamp structure of claim 62 wherein said first locking surface comprises a pin.

64. The clamp structure of claim 63, wherein said pin has a longitudinal axis which is perpendicular to a longitudinal axis of said shaft.

65. The clamp structure of claim 64, wherein said pin is a roll pin.

66. The clamp structure of claim 64, wherein said pin is knurled.

67. The clamp structure of claim 62 wherein said mounting structure is integral with said cam follower.

68. The clamp structure of claim 62, wherein said mounting structure is positioned between said cam follower and said resilient member.

69. The clamp structure of claim 62 in which the resilient member is located between the cam follower and the jaw.

70. The clamp structure of claim 62 wherein said mounting structure encircles a portion of said shaft.

71. The clamp structure of claim 70, wherein said mounting structure has a notch through which said shaft is inserted therethrough.

72. The clamp structure of claim 62 wherein said mounting structure encircles the entire shaft.

73. The clamp structure of claim 72, wherein said mounting structure has an aperture through which said shaft is inserted therethrough.

74. The clamp structure of claim 73, wherein said mounting structure is positioned between said cam follower and said resilient member.

75. The clamp structure of claim 73 wherein said mounting structure is integral with said cam follower.

76. A clamp structure comprising:

a clamp shaft aligned along an axis;

a jaw movably mounted on the shaft and comprising a clamping face laterally offset a predetermined distance from the shaft, said jaw rotating about said axis and moving along said axis;

said jaw further comprising a frictional element compressively engaging said clamp shaft and said jaw so as to produce a frictional force which prevents said jaw from rotating about said axis and simultaneously allows said clamp shaft to rotate about said axis.

77. The clamp structure of claim 76, wherein said frictional element is parallel to said clamp shaft.

78. The clamp structure of claim 77, wherein said clamp shaft is inserted through an opening of said frictional element.

79. The clamp structure of claim 78, wherein said frictional element comprises a spring.

80. The clamp structure of claim 77, wherein said frictional element comprises a spring.

81. The clamp structure of claim 76, wherein said frictional element comprises a spring.

82. The clamp structure of claim 76, wherein said clamp shaft comprises a coupling that rotatably engages said clamp shaft and wherein said frictional element engages said coupling.

83. The clamp structure of claim 82, wherein said frictional element is parallel to said clamp shaft.

84. The clamp structure of claim 83, wherein said clamp shaft is inserted through an opening of said frictional element.

85. The clamp structure of claim 82, wherein said frictional element comprises a spring.

86. The clamp structure of claim 82, wherein said clamp shaft comprises threads that rotatably engage threads formed in said coupling.

87. The clamp structure of claim 86, wherein said frictional element is parallel to said clamp shaft.

88. The clamp structure of claim 87, wherein said clamp shaft is inserted through an opening of said frictional element.

89. The clamp structure of claim 86, wherein said frictional element comprises a spring.

90. A clamp structure comprising:

a clamp shaft aligned along an axis;

a jaw movably mounted on the shaft and comprising a clamping face laterally offset a predetermined distance from the shaft, said jaw rotating about said axis and moving along said axis;

a cam comprising a cam surface;

a connector connecting the cam to the shaft to allow the cam to move, relative to the shaft, between free and clamping positions;

a cam follower operatively connected to the cam surface to be moved thereby in response to movement of the cam;

a cam actuator to move the cam surface from a first position to a second position by urging the clamping face toward a clamping position to exert pressure on a work piece; and a second jaw having a channel to receive said clamp shaft so as to mount said second jaw to said clamp shaft, wherein said channel has a shape that prevents substantial translational movement of said second jaw in a direction other than along said axis.

91. The clamp structure of claim 90 in which the connector comprises a pivot member on which the cam is mounted.

92. The clamp structure of claim 91 in which the pivot member is mounted on the clamp shaft.

93. The clamp structure of claim 92, comprising a resilient member operatively connected between the cam follower and the jaw.

94. The clamp structure of claim 93 in which the resilient member is located between the cam follower and the jaw.

95. The clamp structure of claim 90, comprising a resilient member operatively connected between the cam follower and the jaw.

96. The clamp structure of claim 95 in which the resilient member comprises an annular tube of elastomeric material.

97. The clamp structure of claim 96, comprising a mounting structure to hold the shaft so that the shaft is aligned along a longitudinal direction.

98. The clamp structure of claim 97 wherein said mounting structure encircles a portion of said shaft.

99. The clamp structure of claim 97, wherein said mounting structure holds the shaft between the cam follower and the resilient member.

100. The clamp structure of claim 97, wherein said mounting structure has a notch through which said shaft is inserted therethrough.

101. The clamp structure of claim 97 wherein said mounting structure encircles the entire circumference of the shaft.

102. The clamp structure of claim 101, wherein said mounting structure has an aperture through which said shaft is inserted therethrough.

* * * * *

UNITED STATES PATENT AND TRADEMARK OFFICE

CERTIFICATE OF CORRECTION

PATENT NO. : 5,692,734

DATED : December 2, 1997

INVENTOR(S) : Aldredge, Sr.

It is certified that error appears in the above-indentified patent and that said Letters Patent is hereby corrected as shown below:

In the Claims

In claim 1, line 8, change "sham" to --shaft--.

In claim 1, line 11, change "there by" to --thereby--.

In claim 25, line 14, change "." (period) to --;--.

In claim 59, line 24, change "(h)" to --(g)--.

Signed and Sealed this

Twenty-fifth Day of April, 2000

*Attest:*

*Attesting Officer*

Q. TODD DICKINSON

*Director of Patents and Trademarks*